US008814407B2

(12) United States Patent
Sheikh

(10) Patent No.: US 8,814,407 B2
(45) Date of Patent: Aug. 26, 2014

(54) HARD-SIDED SUITCASE INCLUDING LIGHTING

(75) Inventor: Haroon Sheikh, Miami, FL (US)

(73) Assignee: 2395954 Ontario Inc., Mississauga, Ontario (CA)

( * ) Notice: Subject to any disclaimer, the term of this patent is extended or adjusted under 35 U.S.C. 154(b) by 592 days.

(21) Appl. No.: 12/844,630

(22) Filed: Jul. 27, 2010

(65) Prior Publication Data

US 2011/0187292 A1 Aug. 4, 2011

Related U.S. Application Data

(60) Provisional application No. 61/299,786, filed on Jan. 29, 2010.

(51) Int. Cl.
*F21V 7/04* (2006.01)

(52) U.S. Cl.
USPC ..... 362/551; 362/556

(58) Field of Classification Search
USPC ..... 362/551, 556, 555, 559, 570, 565, 577, 362/582, 602, 97.1, 103
See application file for complete search history.

(56) References Cited

U.S. PATENT DOCUMENTS

| | | | | |
|---|---|---|---|---|
| 1,171,678 | A | | 2/1916 | Trotter |
| 1,947,838 | A | | 2/1934 | Fiss |
| 2,104,935 | A | | 1/1938 | Solomon |
| 2,536,169 | A | | 1/1951 | Gray |
| 3,061,057 | A | | 10/1962 | Miller |
| 3,443,671 | A | | 5/1969 | Dyke |
| 4,773,515 | A | | 9/1988 | Kotkins, Jr. |
| 4,844,215 | A | | 7/1989 | Ambasz |
| 4,926,296 | A | * | 5/1990 | Blume et al. ..... 362/156 |
| D312,352 | S | | 11/1990 | King |
| 5,358,082 | A | | 10/1994 | Armstrong, IV |
| D373,105 | S | | 8/1996 | Imotani |
| 5,676,451 | A | * | 10/1997 | Tabanera ..... 362/156 |
| 5,921,635 | A | | 7/1999 | Deliman et al. |
| 6,000,509 | A | | 12/1999 | Chisholm |
| 6,021,874 | A | | 2/2000 | Nykoluk |
| 6,059,078 | A | | 5/2000 | Nykoluk |
| 6,062,356 | A | | 5/2000 | Nykoluk |
| 6,132,059 | A | | 10/2000 | Leibowitz |
| 6,179,101 | B1 | | 1/2001 | Lin |
| D438,005 | S | | 2/2001 | Tiramani et al. |
| 6,305,514 | B1 | | 10/2001 | Lin et al. |

(Continued)

FOREIGN PATENT DOCUMENTS

CA 2635328 12/2009

*Primary Examiner* — Vip Patel
(74) *Attorney, Agent, or Firm* — Duane Morris LLP

(57) ABSTRACT

A hard-sided suitcase may include polycarbonate shells for forming one or more storage compartments. The suitcase may include fiber-optic fibers or other light emitting devices for providing lighting to the hard-sided suitcase. The fiber-optic fibers may be placed on or within the polycarbonate shells. The suitcase may include a lighting mechanism or controller for sending light through the fiber-optic fibers. The lighting mechanism may be configured to send colored light through the fibers, and to change the light pattern being illuminated at a random and/or predetermined interval. A power source may power to the lighting mechanism. The power source, when switched on, may cause the lighting mechanism to send the light through the fiber-optic fibers. Light emitting diodes may also provide illumination. The lighting mechanism may control the lighting of the light emitting devices individually and simultaneously to facilitate a wide range of potential illumination patterns.

20 Claims, 4 Drawing Sheets

(56) References Cited

U.S. PATENT DOCUMENTS

| | | | | |
|---|---|---|---|---|
| 6,390,259 | B1 | 5/2002 | Lu | |
| D462,169 | S | 9/2002 | Giovanni | |
| 6,460,668 | B1 | 10/2002 | Godshaw et al. | |
| D479,648 | S | 9/2003 | De Lathouwer | |
| 6,695,107 | B2 | 2/2004 | Godshaw et al. | |
| 6,789,932 | B2 * | 9/2004 | Healy | 362/565 |
| 6,932,427 | B2 | 8/2005 | Tamura | |
| 7,055,978 | B2 * | 6/2006 | Worthington | 362/103 |
| 7,093,700 | B2 | 8/2006 | Krulik et al. | |
| D531,411 | S | 11/2006 | Fenton et al. | |
| 7,143,878 | B2 | 12/2006 | Selvi | |
| 7,195,109 | B2 | 3/2007 | Mitchell et al. | |
| 7,296,665 | B2 | 11/2007 | Morszeck | |
| 7,641,030 | B2 | 1/2010 | Selvi | |
| 8,282,235 | B2 * | 10/2012 | Gilligan | 362/156 |
| 2003/0179569 | A1 * | 9/2003 | Huang | 362/109 |
| 2004/0065519 | A1 | 4/2004 | Morszeck | |
| 2004/0076000 | A1 | 4/2004 | Thorp | |
| 2006/0196743 | A1 | 9/2006 | Lin | |
| 2007/0133195 | A1 | 6/2007 | Gorton | |
| 2007/0153503 | A1 * | 7/2007 | Feng | 362/156 |
| 2008/0099290 | A1 | 5/2008 | Stern | |
| 2009/0314677 | A1 | 12/2009 | Teggatz et al. | |

* cited by examiner

HARD-SIDED SUITCASE INCLUDING LIGHTING

CROSS-REFERENCE TO RELATED APPLICATION AND PRIORITY

The present patent application claims priority to U.S. Patent Provisional Application No. 61/299,786, filed Jan. 29, 2010 and entitled "Hard-Sided Suitcase Including Lighting," which is incorporated by reference in its entirety herein.

FIELD OF THE INVENTION

The present application relates to luggage, and more particularly to a hard-sided suitcase for carrying and storing various types of articles, which features lighting.

BACKGROUND

Currently, consumers have a variety of different options when it comes to storing their personal belongings and/or other articles. For example, consumers may use suitcases, briefcases, computer cases, beauty cases, business cases, travel bags, and a host of other types of cases. Consumers often spend considerable resources to ensure that they have suitcases which are both durable, and easy to transport. However, many consumers also put significant importance on the style and attractiveness of the suitcase as well. Accordingly, many suitcases come with decorated exteriors and interiors, which may often be utilized to distinguish the suitcases from various other brands. Such suitcases often include stylish exterior and interior trim, pockets, and other features to attract the consumer.

SUMMARY

A suitcase may include light emitting devices, fiber-optic lighting, or other illumination. The suitcase may include a laser(s) or other similar lighting mechanism which may be utilized to transmit light through optical fibers in the suitcase. When the light is being transmitted the through the fibers, the light may be seen wherever the fibers are located, such as on either a hard-sided or soft-sided shell of the suitcase. The lasers or lighting mechanism may allow multiple colors to be seen through the optical fibers simultaneously, and may change the color of light passing through each fiber at random or at predetermined time intervals. As a result, the lights may appear as if they are moving along the surface of the suitcase. The rate at which the lasers or lighting mechanism changes the color of light, and/or how long the lights remain on or off, may be user-selectable or programmable. The suitcase may include an on/off switch to allow the user to turn the lights off and on. Any number of lights and/or arrangements of the lights may be utilized according to the invention.

In one aspect, a hard-sided suitcase may be provided. The hard-sided suitcase may include at least one polycarbonate shell for forming storage compartments of the hard-sided suitcase. The suitcase may include a plurality of fiber-optic fibers for providing lighting to the hard-sided suitcase, wherein at least a portion of the plurality of fiber-optic fibers are placed on one or more of the polycarbonate shells. Additionally, the suitcase may include a lighting mechanism for outputting light through the plurality of fiber-optic fibers. The lighting mechanism may be configured to output at least one color of light through the plurality of fiber-optic fibers, and change the output of the light in at least one of a random and/or predetermined interval. Furthermore, the suitcase may include a power source for providing power to the lighting mechanism. The power source, when switched on, may cause the lighting mechanism to output light through the plurality of fiber-optic fibers, and when the power source is switched off, the lighting mechanism may not output light through the plurality of fiber-optic fibers.

In another aspect, a suitcase having a lighting mechanism for illumination of a surface of the suitcase may be provided. The suitcase may include either a hard shell or a soft shell configured to form a storage compartment of the suitcase, and a plurality of fiber-optic fibers configured to provide lighting to the hard or soft shell. At least a portion of the plurality of fiber-optic fibers may be positioned on or in the vicinity of a surface on the hard or soft shell. A lighting mechanism may be configured to send light through the plurality of fiber-optic fibers. The lighting mechanism may be configured to send at least one color of light through the plurality of fiber-optic fibers, and to change a manner in which the light being sent through the plurality of fiber-optic fibers is being generated. The suitcase may include a power source configured to provide power to the lighting mechanism. During use, when switched on, the power source may cause the lighting mechanism to send light through the plurality of fiber-optic fibers, and when the power source is switched off, the lighting mechanism may not send light through the plurality of fiber-optic fibers.

In another aspect, a suitcase having light emitting devices for illumination of a surface of the suitcase may be provided. The suitcase may include a hard or soft shell configured to form a storage compartment of the suitcase, and light emitting devices configured to provide illumination of a surface of the hard or soft shell. The light emitting devices may be positioned on or within the hard or soft shell. The suitcase may include a lighting mechanism or controller configured to control lighting of the light emitting devices in a plurality of user-selectable manners. Each of the user-selectable manners may illuminate the surface of the hard or soft shell via the light emitting devices in a different manner.

Advantages of the present invention will become more apparent to those skilled in the art from the following description of the preferred embodiments of the invention which have been shown and described by way of illustration. As will be realized, the invention is capable of other and different embodiments, and its details are capable of modification in various respects. Accordingly, the drawings and description are illustrative in nature and not restrictive.

BRIEF DESCRIPTION OF THE DRAWINGS

There are shown in the drawings arrangements which are presently discussed, it being understood, however, that the invention is not limited to the precise arrangements and instrumentalities shown, wherein.

DETAILED DESCRIPTION OF THE INVENTION

Figure 1:
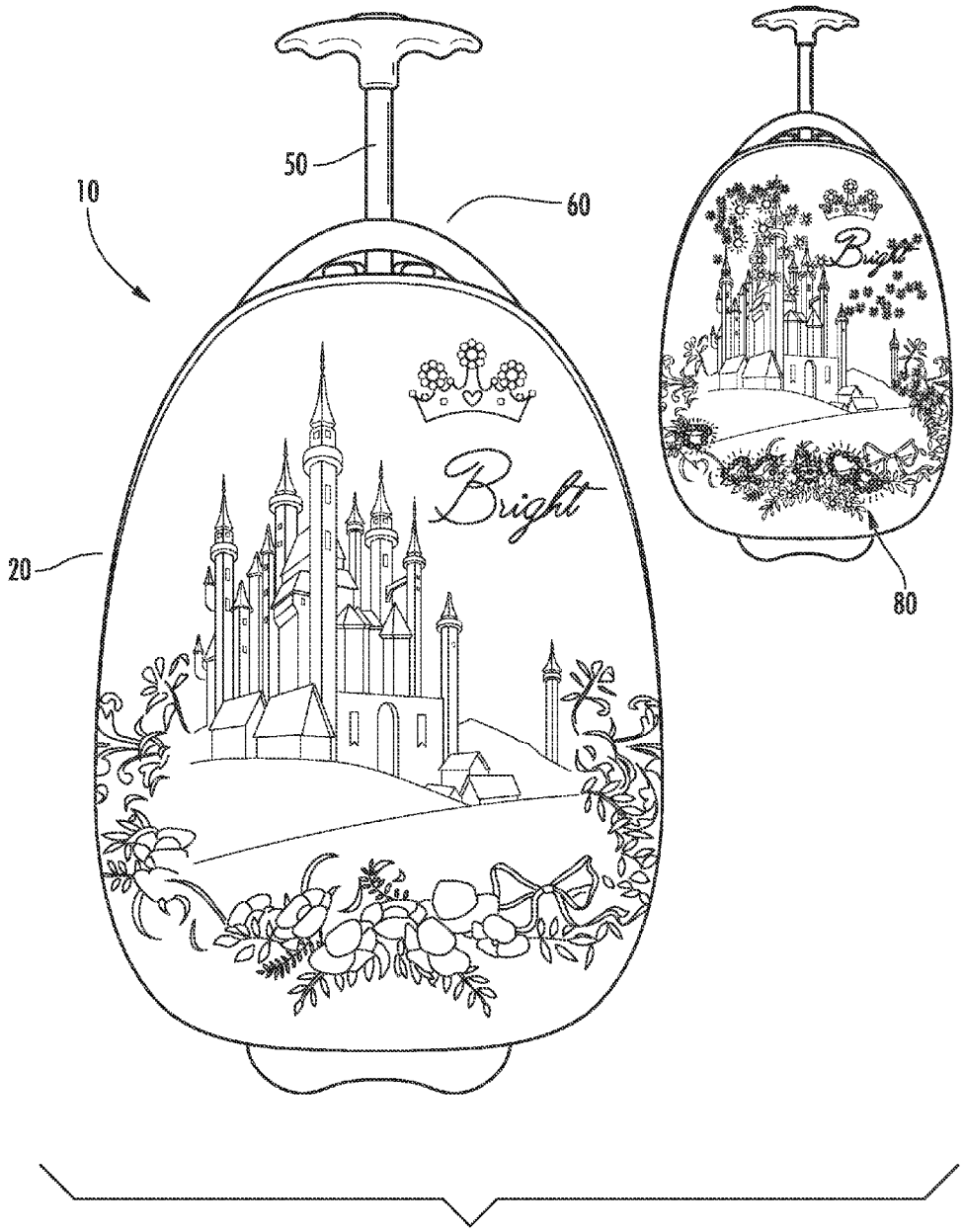
FIG. 1 illustrates a hard-sided suitcase featuring fiber-optic lights placed on at least a portion of a polycarbonate shell of the suitcase according to one embodiment of the invention.

The exemplary embodiments of the present disclosure are described with respect to a hard-sided suitcase for carrying and/or storing different types of articles. It should be understood by one of ordinary skill in the art that the exemplary embodiments of the present disclosure may be applied to other types of hard-sided suitcases. Referring to the drawings, an embodiment of a hard-sided suitcase 10 for storing articles is illustrated. The term "suitcase" as used herein is intended to encompass a variety of different types of luggage. For example, the suitcase may be a traditional suitcase, a briefcase, a laptop bag/case, a computer bag/case, a business case, a travel bag, a beauty case, or a variety of other types of luggage. Of course, the aforementioned types of suitcases are merely for illustrative purposes and are not intended to limit the suitcase to the listed varieties.

The hard-sided suitcase 10 may include front, back, side, and top and bottom portions. The suitcase 10 may include two hard-sided shells 20, which may be utilized to form one or more storage compartments for the hard-sided suitcase 10. Outer portions of the hard-sided shells may form at least a portion of the front, back, sides, top and bottom portions. The inner portions of the hard-sided shells may be lined with various types of fabrics or other similar features and may include one or more pockets, which may be open and closed through zipper mechanisms or other mechanisms for opening and closing pockets. A suitable lining material is nylon, although of course any other materials may be used. The two of the hard-sided shells may be utilized to form a primary compartment. One or more other hard-sided shells may be utilized to form secondary compartments as well.

Notably, the shells may be comprised of a thermoplastic composition or other similar composition. In an embodiment, the shells may be comprised of a polycarbonate composition, which may include adding one or more other substances to the composition, such as ABS plastic and the like. The polycarbonate composition is lightweight and may enable the shells to be flexible, while maintaining a generally rigid form. When stressors are applied to the shells, the polycarbonate composition may allow the shells to absorb the impact from the stressors and cause the shells to flex to accommodate the stressors. After the stressors have been removed, the polycarbonate composition may enable the suitcase to return to its original shape.

The shells 20 may be provided in a decorative shape, such as an ovoid shape, or any other suitable shape. Alternatively, the shells may be a standard rectangular or square shape. Other shapes may be used.

The hard-sided shells 20 may be connectable to one another through the use of a zipper or other fastening mechanism such as, but not limited to, snap fasteners, buttons, and buckles. Each side of the zipper may include a plurality of metal or plastic teeth, which may be stitched or otherwise attached to corresponding pieces of fabric tape. The fabric tape may be comprised of ballistic nylon or other similar materials. One fabric tape may be stitched or otherwise fastened to an edge of one of the hard-sided shells and the other fabric tape may be fastened to an edge of another hard-sided shell. The zipper may include one or more sliders, which may be configured to hold at least a portion of the plurality of teeth on each side of the zipper. Once the slider is slid across the plurality of teeth, it may be utilized to connect the edges of the hard-sided shells together, which forms a seal for the storage compartments within the shells.

In one embodiment, the zipper may be slid across the entire edges of the hard-sided shells. Such a configuration would allow the compartments to be entirely or almost entirely separated upon completely unzipping the edges from one another. However, in another embodiment, the suitcase may have a hinge, preferably along the bottom portion of the suitcase. The hinge may permanently connect at least a portion (such as the bottom portion) of the edges of the hard-sided shells together. The remaining portions of the edges that are not connected by the hinge may be connectable via the zipper mechanism. By utilizing the hinge, this may allow the hard-sided shells to remain at least partially connected to one another, particularly in the event that the zipper fails.

Additionally, the suitcase 10 may include one or more handles for carrying, pulling, pushing, and/or lifting the suitcase. The handles may include a telescoping handle 50. The telescoping handle 50 may be connected to a top portion or other portion of a hard-sided shell so as to allow for easy transportation of the suitcase. The telescoping handle 50 may be operated by a lock button.

The handle 50 may include trolley tubes, which may extend through a portion of the hard-sided shell to which it is attached. This type of arrangement may allow for additional structural support and allows the handle to undergo a greater amount of stress. In one embodiment, the trolley tubes may be encased within the storage compartment into a protrusion along the backside of the hard-sided shell. The encasing may be performed laying a fabric, plastic, or other material across the trolley tubes so as to ensure the flat surface. Once the trolley tubes are encased, a flat surface may be created across the trolley tubes. This arrangement may allow one to pack the compartment of the suitcase without having to pack around the trolley tubes, while also ensuring a more uniform compartment space.

One or more carry handles 60 may also be provided. For example, one carry handle 60 may be provided on each of the top and side of the suitcase 10 on a large suitcase, whereas only one carry handle 60 may be sufficient on the top of a smaller suitcase 10, such as a briefcase.

The suitcase 10 may be configured to include a plurality of wheels for transporting the suitcase. Each wheel may include a hub portion and a rubber portion which surrounds the hub portion. The hub portion of each wheel may be affixed to the suitcase 10, while also allowing each wheel to spin when the suitcase 10 is rolled by a user. In one configuration, two wheels may be connected to a bottom portion of a hard-sided shell, preferably along the opposite ends of the bottom of the shell. In another configuration, another set of wheels may be connected to a bottom portion of another hard-sided shell so as to allow for four wheels positioned at the four ends of the bottom of the suitcase. Any number of wheels and any position for placement of the wheels may be utilized as well.

For example, one wheel may be placed on a bottom portion of one hard-sided shell and two wheels may be placed on a bottom portion of another hard-sided shell. Such a positioning may allow for greater stability and for easier transportation of the suitcase. In one embodiment, the rubber portions and/or the hub portions of the wheels may be plated with chrome or another similar material. Plating the rubber portions and/or the hub portions of the wheels with chrome or other similar materials may enable the wheels to rotate along a variety of surfaces in a smooth and easy motion by minimizing friction and drag along the surfaces.

The suitcase 10 may be configured to have one or more expandable portions, which may be utilized to expand one or more storage compartments of the suitcase. The expandable portion may be connected to at least one of the hard-sided shells either at an edge of the shell or otherwise and may be made of fabric such as nylon or other materials which may expand. Notably, the expandable portion may be secured in a non-expanded state by utilizing a zipper or other similar securing mechanism. When an individual pulls a slider to open the zipper for the expandable portion, the expandable portion may expand so as to increase the storage capacity of the suitcase. If the individual would like to return the suitcase to its original size, the individual may merely need to close the zipper mechanism using the slider mechanism.

In another embodiment, the suitcase 10 may include a locking mechanism for preventing unauthorized access to one or more compartments of the suitcase. The locking mechanism may be a conventional lock and key mechanism, a combination lock, a key code lock, a radio frequency identification lock, or other types of lock.

In another embodiment, the suitcase 10 may also include various forms of lights 80 and/or lighting, particularly for use with children's cases which are sized to be carried on to an airplane. For example, the lights may be fiber-optic lights, light emitting diodes, halogen lights, xenon lights, incandescent lights, fluorescent lights, or other types of lighting. The lights may be configured to be placed on the actual hard-sided shells or on other locations of the suitcase 10, such as inside one or more storage compartments of the suitcase. Moreover, the lights may be placed on the hard-sided shell in a manner that will not allow children to readily grab at, dislodge, and/or damage the lights. The suitcase may also include a power source for powering the lights, which, for example, may be a battery, chargeable power source, or other power source.

In one embodiment, the power source may be located within the suitcase so as to prevent inappropriate access to the power source and to shield the power source from damage. Other locations of the power source may be used.

In the case of fiber-optic lighting, the suitcase may include a laser or other similar lighting mechanism which may be utilized to transmit light through optical fibers in the suitcase. When the light is being transmitted the through the fibers, the light may be seen wherever the fibers are located, such as on the hard-sided shell. The laser may allow multiple colors to be seen through the optical fibers. For example, the laser may allow colors such as, but not limited to, white, green, blue, violet, yellow, clear, indigo, and/or any color producible in the visible wavelength range of 400-700 nm to be seen through the optical fibers. Additionally, the laser may change the colors at random or at predetermined time intervals through each fiber. This may allow the lights to appear as if they are moving along the suitcase.

A user may be provided with the option of changing the rate at which the laser changes the colors or specifying how long the lights remain off or on. The suitcase may feature an on/off switch which may be located on top of the suitcase or within the suitcase, which may allow an individual to easily turn on and off the lights at will. In one embodiment, the on/off switch may be placed on a location of the suitcase which is difficult to accidentally switch on or off. Any number of lights and/or arrangements of the lights may be utilized according to the present embodiments.

In a preferred arrangement, the lights may be incorporated into a decorative pattern on the surface of the suitcase 10. The decorative pattern may be provided on the surface of the suitcase by means of printing, a stick-on image, painting, or any other method. The decorative pattern may include characters, cartoons, flowers, fairies and any other suitable images. The lights may be used to highlight particular areas of the decorative pattern. The illumination of the surface of the suitcase may include one or more solid colors.

I. Exemplary Embodiments

In one embodiment, a suitcase may include fiber-optic lighting or illumination. The suitcase may include a laser or other similar lighting mechanism which may be utilized to transmit light through the optical fibers in and/or on the suitcase. When the light is being transmitted the through the fibers, the light may be seen wherever the fibers are located, such as on either a hard-sided or soft-sided shell of the suitcase. The laser(s) may allow multiple colors to be seen through the optical fibers simultaneously and may change the colors at random.

Alternatively or additionally, the laser(s) may allow multiple colors to be seen through the optical fibers that change at predetermined time intervals through each individual fiber. The laser(s) or a processor on the suitcase may control the light running through each individual fiber to create one or more light patterns of illumination. Random patterns of illumination may provide a unique viewing experience each time the suitcase is used.

The lights running through the optical fibers may appear as if they are moving along the surface of the suitcase. The rate at which the laser(s) or lighting mechanism changes the color of light through each fiber or how long each of the colored lights remain on or off within a given fiber may be user-selectable. The suitcase may include an on/off switch to allow the user to turn the lights on and off.

The suitcase may include other controls or buttons that allow a user to select random and/or predetermined patterns of illumination of colored light running through the optical fibers. The light may be provided in multiple colors. The random and/or predetermined patterns may be based on individual fibers or groups of fibers. The length of time that a light, and the color of the light, running through each fiber may be randomly selected, such as via a processor. Alternatively, the fibers may be separated into a number of predetermined or changing groups. The length of time that a light, and the color of the light, running through each fiber within a group may also be randomly selected.

The suitcase may include decorative faceplates or other designs that are illuminated by the optical fibers or other light emitting devices, such as light emitting diodes, halogen lights, xenon lights, incandescent lights, fluorescent lights, or other types of lighting. The light emitting devices may be arranged into a design or pattern on a surface of the suitcase.

In another embodiment, a suitcase having a fighting mechanism for illumination of a surface of the suitcase may include a hard or soft shell configured to form a storage compartment of the suitcase, and a plurality of fiber-optic fibers configured to provide lighting to the hard or soft shell. At least a portion of the plurality of fiber-optic fibers may be placed on or within the hard or soft shell. Further, a lighting mechanism may be configured to send light through the plurality of fiber-optic fibers. The lighting mechanism may be configured to send at least one color of light through the plurality of fiber-optic fibers, and to change a manner in which the light being sent through the plurality of fiber-optic fibers is being generated. The suitcase may include a power source configured to provide power to the lighting mechanism. During use, when switched on, the power source may cause the lighting mechanism to send light through the plurality of fiber-optic fibers, and when the power source is switched off, the lighting mechanism may not send light through the plurality of fiber-optic fibers.

In another embodiment, a suitcase having a lighting mechanism for illumination of a surface of the suitcase may include a hard or soft shell configured to form a storage compartment of the suitcase, and a plurality of fiber-optic fibers configured to provide lighting to the hard or soft shell. The fiber-optic fibers may be positioned on the hard or soft shell. Further, the suitcase may include a lighting mechanism configured to send light through the plurality of fiber-optic fibers in a plurality of user-selectable manners.

In any of the embodiments, the plurality of user-selectable manners of controlling illumination may include sending light though the plurality of fiber-optic fibers in a random manner. The random manner may include different colored light being sent through all of the fiber-optic fibers or individual ones of the fibers, and at different intervals. The plurality of user-selectable manners may include sending light though the plurality of fiber-optic fibers at a predetermined interval, or sending solid colors of light that do not blink. Other user-selectable manners of controlling the illumination may be used.

The suitcase may include a soft shell that is illuminated by one or more fiber-optic fibers, or other light emitting devices, including those discussed herein. The soft shell may be manufactured from fabric or compressible material, or other suitcase material. Alternatively or additionally, the suitcase may include a hard shell that is illuminated by one or more fiber-optic fibers, or other light emitting devices. The hard shell may be manufactured from a polycarbonate based material, plastic, metal, ABS, PVC, thermoplastic, or other material such that during use the hard shell substantially retains its shape.

The suitcase may include a decorative pattern. During use, a light pattern of illumination generated by the plurality of fiber-optic fibers or other light emitting devices may highlight particular areas of the decorative pattern on the surface of the hard or soft shell of the suitcase. The fiber-optic fibers or light emitting devices may be powered by a rechargeable battery located within the suitcase or a wall of the suitcase. The power source may be turned on and off by a switch located on the suitcase.

II. Exemplary Controller and User-Selectable Modes of Illumination

In another embodiment, a suitcase may have light emitting devices for illumination of a surface of the suitcase. The suitcase may include a hard or soft shell configured to form a storage compartment of the suitcase, and light emitting devices configured to provide illumination of a surface of the hard or soft shell. The light emitting devices may be positioned on or within the hard or soft shell. The suitcase may include a lighting mechanism or controller configured to control lighting of the light emitting devices in a plurality of user-selectable manners. Each of the user-selectable manners may illuminate the surface of the hard or soft shell via the light emitting devices in a different manner. The controller of the light emitting devices may control illumination of the light emitting devices in one or all of the user-selectable manners of illumination discussed herein.

The suitcase may include hardwiring control between the multiple components, such as the optical fibers, light emitting devices, lighting mechanism, and/or power supply. Alternatively or additionally, the suitcase may include one or more processors that act as controllers. The processors may include reprogrammable or embedded memory, a power source, and a transceiver for wireless communication. The processor may be run by instructions stored on the memory, and may operate in a number of user-selectable modes. The user-selectable modes may include (1) on/off modes, (2) random modes, (3) predetermined pattern modes, (4) predetermined sequencing modes, and/or other modes.

A user may select a user-selectable mode by switch, entry of a code, voice command, remote control, button control, user interface entry, or other entry mode. For instance, the suitcase may include a small touch display screen interconnected with the processor that provides for selection of a user-selectable mode from a menu displayed on the screen. The touch display screen may include haptic or vibration feedback.

The user-selectable on/off mode may turn on and off all or a portion of the optical fibers or light emitting device. The optical fibers or light emitting devices that are turned on may be turned on in a set color or a set of predetermined colors.

The user-selectable random mode may rotate which optical fibers have light running though them or which light emitting devices are on. Additionally or alternatively, the user-selectable random mode may rotate the color running through some or all of the optical fibers having light running through them, the color of individual light emitting devices, or which light emitting devices are on.

The user-selectable predetermined pattern mode may send light through pre-selected optical fibers or other light emitting devices that have been predetermined to make a pattern. The user-selectable predetermined pattern mode may highlight certain portions of decorative faceplates or patterns on the surfaces of the suitcase. The user may select the predetermined pattern from a plurality of predetermined patterns.

The user-selectable predetermined sequencing mode may include rotating which individual or groups of optical fibers or light emitting devices are emitting light in a predetermined timing sequence. The user-selectable predetermined sequencing mode may include rotating groups of multiple optical fibers or light emitting devices that are on, are displaying a particular color, or displaying a particular pattern. The predetermined sequencing mode may rotate colors and patterns being displayed via the optical fibers or light emitting devices.

The user-selectable modes may include combinations of the above user-selectable modes. Each of the user-selectable modes may include modes having additional, fewer, or alternate features. Other user-selectable modes may be used.

III. Exemplary Method of Manufacture and Use of Illuminated Suitcase

Figure 4:
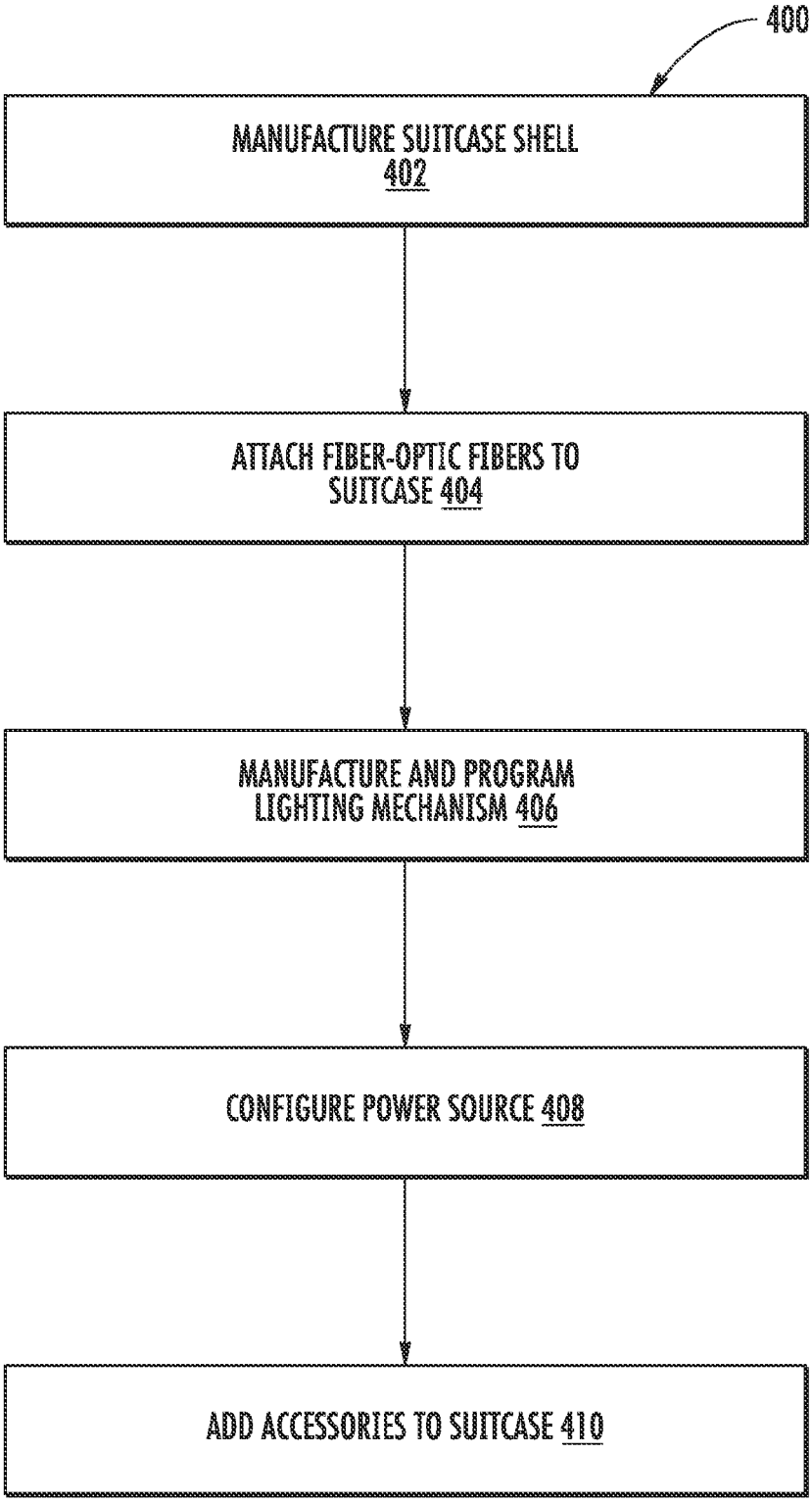
FIG. 4 illustrates a method of illuminating a surface of a suitcase.

FIG. 4 illustrates an exemplary method of manufacture and use of an illuminated suitcase. The method may include manufacturing the suitcase shell 402, attaching fiber-optic fibers or other light emitting devices to the suitcase 404, manufacturing and programming a lighting mechanism or controller 406, configuring a power source 408, and adding accessories to the suitcase 410. The method may include additional, fewer, or alternate actions.

The method 400 may include manufacturing a suitcase shell 402. For instance, a right and left hard shell may be manufactured. The right and left hard shells may be manufactured from ABS plastic, PVC, metal, plastic, forms of thermoplastic, polycarbonate, or any combination thereof or any combination of other plastics known in the art. The hard shells may be smooth and configured to be devoid of sharp corners. The hard shells may retain their shape during use and/or when the suitcase is empty. In one embodiment, the right and left hard shells may be configured to have the same or substantially the same shape and/or storage capacity. Alternatively, one of the hard shells may be larger than the other.

The suitcase shell may alternatively be a soft shell. The soft shell may be manufactured from a fabric material, such as nylon or polyester. In between the shells may be an zipper arrangement, an expandable zipper arrangement, a gusset, fabric, or other expandable means for expanding the size of the suitcase.

The method 400 may include attaching fiber-optic fibers or other light emitting devices to the suitcase 404. A plurality of fiber-optic fibers or other light emitting devices may be configured to provide lighting to the hard or soft shell. At least a portion of the plurality of fiber-optic fibers or light emitting devices may be placed on or within an exterior surface of the hard or soft shell.

For example, the fiber-optic fibers or light emitting devices may be stitched or otherwise attached to one or more surfaces of the hard or soft shells. The fiber-optic fibers or light emitting devices may alternatively or additionally be stitched to a frame or rim extended around the exterior of one or more shells. In one embodiment, the fiber-optic fibers or light emitting devices may be arranged in a predetermined pattern on the surface of the hard or soft shells, such as spelling out a word or forming a recognizable image, such as an animal, a logo, a graphic image, a trade name, a name of a company or service, an image of a celebrity, or other image, such as shown in FIGS. 1, 2, & 3.

Figure 2:
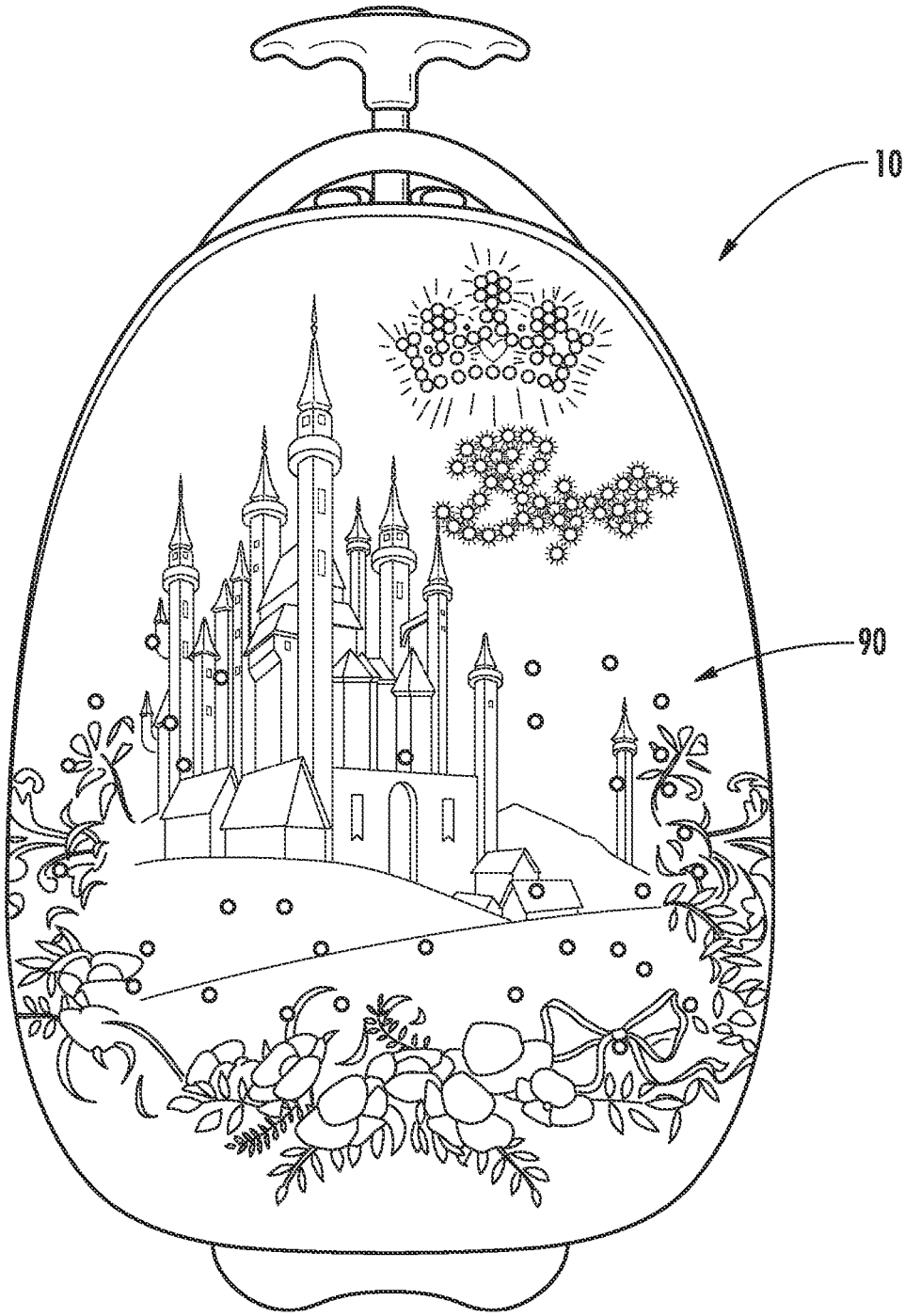
FIG. 2 illustrates a lit hard-sided suitcase featuring fiber-optic lights placed on a polycarbonate shell of the suitcase.
Figure 3:
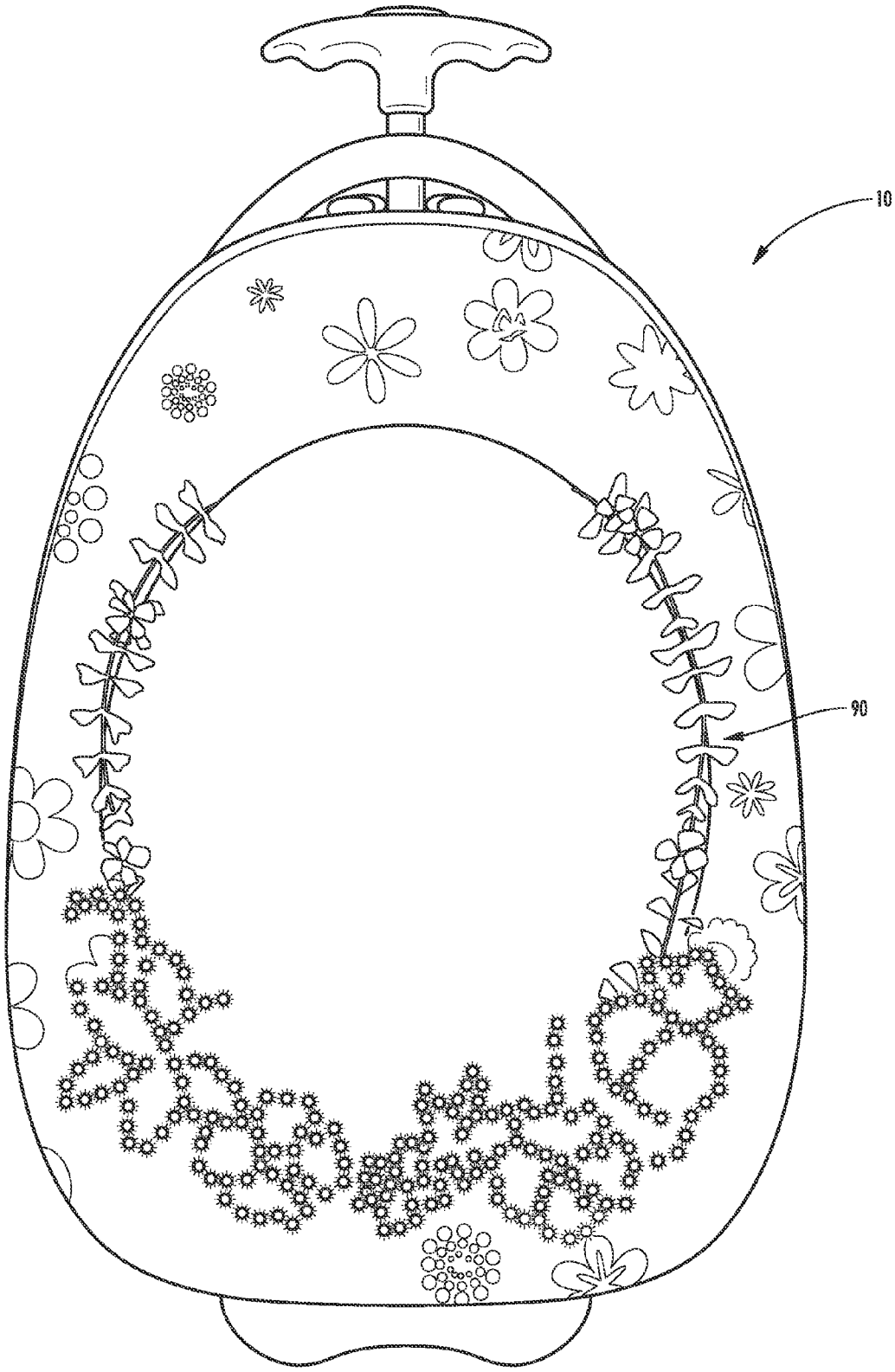
FIG. 3 illustrates another hard-sided suitcase including fiber-optic lighting.

FIGS. 2 and 3 illustrate a hard suitcase 10 with a decorative pattern or other pattern 90 on the exterior surface. A number of light emitting devices may be arranged to form or highlight the decorative patterns 90. For instance, the light emitting devices may form a shape, such as a crown. The light emitting devices may form a word, such as Spirit or Bright, or a phrase, such as "Pixie Dust Hits the Spot."

The method 400 may include manufacturing and programming a lighting mechanism 406. The lighting mechanism may be configured to send light through a selected group of or a plurality of fiber-optic fibers, or control a group of other light emitting devices. The lighting mechanism may be configured to send at least one color of light through the plurality of fiber-optic fibers, and to change a manner in which the light being sent through the plurality of fiber-optic fibers is being generated.

The lighting mechanism may be configured to run a single color of light or multiple colors of light through one or more fiber-optic fibers or other light emitting devices. The lighting mechanism may alternatively or continuously run light through groups of and/or individual fiber-optic fibers or light emitting devices. The lighting mechanism may be hardwired, include a programmable processor, or be attached to a programmable or other processing or control unit.

For instance, the lighting mechanism, or a processor attached thereto, such as the processor discussed above, may be configured to individually control which fibers or light emitting devices are on or off, what color of light runs through each fiber or device, which groups of fibers or devices are on or off, or what color of light runs through a group of fibers or devices. The lighting mechanism may include additional, less, or alternative functionality. For instance, in an alternative embodiment, the lighting mechanism may control the manner in which a number of light emitting diodes or other devices are illuminated.

The method 400 may include configuring the power source 408. The power source may be configured to provide power to the lighting mechanism. During use, when switched on, the power source may cause the lighting mechanism to send light through the plurality of fiber-optic fibers, or turn on other types of light emitting devices. When the power source is switched off, the lighting mechanism may not send light through the plurality of fiber-optic fibers, or turn off the other types of light emitting devices.

The power supply, like the lighting mechanism, may be hard wired, include a dedicated processing unit, and/or be in communication with an overall controller associated with the suitcase or other processing unit. The power supply may be controlled by the dedicated processing unit or overall controller, or by direct wiring to user operable controllers. In an embodiment, the power supply, the lighting mechanism, and/or processor may be controlled by remote control devices. For example, a key fob, key ring device, remote controller, or other similar device may be utilized. Other configurations may be used.

The method 400 may include adding accessories to the suitcase 410. The accessories may facilitate or enhance the visual effects of the illumination by the fiber optics or light emitting devices by a viewer. For instance, decorative faceplates and engravings may be added to the suitcase. Reflective pieces or glass mirrors may be attached to the suitcase to enhance the visual experience of the illumination. Further accessories may include electronic components such as processing units, display screens, haptic controls, audio devices, or other electronic components. Additional, fewer, or alternate visual enhancing accessories may be added to the suitcase, including those discussed herein.

The arrangements described herein are intended to provide a general understanding of the structure of various embodiments, and they are not intended to serve as a complete description of all the elements and features of apparatus and systems that might make use of the structures described herein. Many other arrangements will be apparent to those of skill in the art upon reviewing the above description. Other arrangements may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

Thus, although specific arrangements have been illustrated and described herein, it should be appreciated that any arrangement calculated to achieve the same purpose may be substituted for the specific arrangement shown. This disclosure is intended to cover any and all adaptations or variations of various embodiments and arrangements of the invention. Combinations of the above arrangements, and other arrangements not specifically described herein, will be apparent to those of skill in the art upon reviewing the above description.

Therefore, it is intended that the disclosure not be limited to the particular arrangement(s) disclosed as the best mode contemplated for carrying out this invention, but that the invention will include all embodiments and arrangements falling within the scope of the appended claims.

What is claimed is:

1. A hard-sided suitcase comprising:

at least one polycarbonate shell forming a storage compartment of the hard-sided suitcase;

a plurality of fiber-optic fibers for providing lighting to the hard-sided suitcase, wherein at least a portion of the plurality of fiber-optic fibers are placed on a surface of the at least one polycarbonate shell;

a lighting mechanism configured to output light through the plurality of fiber-optic fibers, wherein the lighting mechanism is configured to output at least one color of light through the plurality of fiber-optic fibers, and to change the output of the light so that, in a first mode, the light is rotated between the plurality of fiber-optic fibers randomly, and, in a second mode, the light is rotated between the plurality of fiber-optic fibers and at least one predetermined interval; and a power source configured to provide power to the lighting mechanism, wherein a light pattern of illumination of the surface of the hard-sided suitcase is user-selectable between at least the first and second modes.

2. The hard-sided suitcase of claim 1, wherein the light pattern of illumination generated by the plurality of fiber-optic fibers comprises a plurality of colors.

3. The hard-sided suitcase of claim 2, wherein the light pattern of illumination generated by the plurality of fiber-optic fibers highlights particular areas of a decorative pattern on the surface of the at least one polycarbonate shell.

4. The hard-sided suitcase of claim 3, wherein the lighting mechanism is powered by a rechargeable battery located within the suitcase or a wall of the suitcase.

5. A suitcase comprising:

a hard or soft shell forming a storage compartment of the suitcase;

a plurality of fiber-optic fibers for providing lighting to the hard or soft shell, wherein the plurality of fiber-optic fibers are positioned on or in the vicinity of a surface on the hard or soft shell;

a lighting mechanism configured to send light through the plurality of fiber-optic fibers, wherein the lighting mechanism is configured to send at least one color of light through the plurality of fiber-optic fibers, and to change a manner in which the light is being sent through the plurality of fiber-optic fibers so that, in a first mode, the light is rotated between the plurality of fiber-optic fibers randomly; and a power source configured to provide power to the lighting mechanism, wherein, when switched on, the power source causes the lighting mechanism to send light through the plurality of fiber-optic fibers, and when the power source is switched off, the lighting mechanism does not send light through the plurality of fiber-optic fibers.

6. The suitcase of claim 5, wherein, in the first mode, the lighting mechanism simultaneously sends light of a plurality of colors through different ones of the plurality of fiber-optic fibers.

7. The suitcase of claim 5, wherein the lighting mechanism is configured to change the manner in which the light is being sent though the plurality of fiber-optic fibers so that, in a second mode, the light is rotated between the plurality of fiber-optic fibers at predetermined intervals.

8. The suitcase of claim 7, comprising a control that allows a user to select between the first and second modes.

9. The suitcase of claim 8, wherein the lighting mechanism is configured to send light of a plurality of colors through the plurality of fiber-optic fibers, and color and on/off states are rotated between the fiber-optic fibers.

10. The suitcase of claim 5, wherein the lighting mechanism is configured to control a light traveling through each individual ones of the plurality of fiber-optic fibers.

11. The suitcase of claim 5, wherein a light pattern of illumination generated by the plurality of fiber-optic fibers highlights particular areas of a decorative pattern on the surface of the hard or soft shell of the suitcase.

12. The suitcase of claim 5, wherein the plurality of fiber-optic fibers are powered by a rechargeable battery located within the suitcase or a wall of the suitcase.

13. A suitcase comprising:

a hard or soft shell forming a storage compartment of the suitcase;

light emitting devices configured to provide illumination of a surface of the hard or soft shell with light of a plurality of colors, wherein the light emitting devices are positioned on or within the hard or soft shell; and a controller configured to control lighting of the light emitting devices in a plurality of user-selectable modes, wherein the plurality of user-selectable modes comprises a random mode in which at least one of color and on/off states is rotated randomly between the light emitting devices.

14. The suitcase of claim 13, wherein, in the random mode, color and on/off states are rotated randomly between the light emitting devices.

15. The suitcase of the claim 13, wherein the plurality of user-selectable modes comprises a predetermined pattern mode in which light is sent to pre-selected ones of the light emitting devices that have been predetermined to make a pattern of illumination.

16. The suitcase of claim 15, wherein the pattern of illumination generated by the light emitting devices highlights particular areas of a decorative pattern on the surface of the hard or soft shell of the suitcase.

17. The suitcase of claim 13, wherein the light emitting devices are powered by a rechargeable battery located within the suitcase or a wall of the suitcase.

18. The suitcase of claim 13, wherein the power source may be turned on and off by a switch located on the suitcase, and the light emitting devices comprise at least one of light emitting diodes and optical fibers.

19. The suitcase of claim 13, wherein the plurality of user-selectable modes comprises a predetermined sequencing mode in which at least one of color and on/off states is rotated between the light emitting devices according to a predetermined timing sequence.

20. The suitcase of claim 13, comprising a touch display screen connected to the controller for providing for selection of the user-selectable modes from a menu displayed on the touch display screen.

* * * * *

UNITED STATES PATENT AND TRADEMARK OFFICE

CERTIFICATE OF CORRECTION

PATENT NO. : 8,814,407 B2
APPLICATION NO. : 12/844630
DATED : August 26, 2014
INVENTOR(S) : Haroon Sheikh It is certified that error appears in the above-identified patent and that said Letters Patent is hereby corrected as shown below:

In the Claims

Column 10, line 64, delete “and” and insert therefor --at--

Column 12, line 26, delete “the” before the word claim

Signed and Sealed this
Eighteenth Day of November, 2014

Michelle K. Lee

Michelle K. Lee
*Deputy Director of the United States Patent and Trademark Office*